US010876784B2

(12) United States Patent
Arslankiray et al.

(10) Patent No.: US 10,876,784 B2
(45) **Date of Patent: *Dec. 29, 2020**

(54) HOME APPLIANCE DOOR

(71) Applicant: BSH HAUSGERAETE GMBH, Munich (DE)

(72) Inventors: Ziya Arslankiray, Tekirdag (TR); Ercan Engin, Tekirdag (TR); Tanzer Yildizgoecer, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 565 days.

This patent is subject to a terminal disclaimer.

(21) Appl. No.: 15/360,179

(22) Filed: Nov. 23, 2016

(65) Prior Publication Data

US 2018/0142939 A1 May 24, 2018

(51) Int. Cl.

| | |
|---|---|
| ***F25D 23/02*** | (2006.01) |
| ***A47F 3/04*** | (2006.01) |
| ***F25D 11/00*** | (2006.01) |

(52) U.S. Cl.

CPC ..... *F25D 23/02* (2013.01); *A47F 3/0434* (2013.01); *F25D 11/00* (2013.01); *F25D 23/028* (2013.01)

(58) Field of Classification Search

CPC ..... A47F 3/0434; A47F 3/043; F25D 23/08; F25D 23/02; F25D 23/028

See application file for complete search history.

(56) References Cited

U.S. PATENT DOCUMENTS

| | | | | |
|---|---|---|---|---|
| 5,048,233 | A * | 9/1991 | Gidseg | E06B 3/78 126/198 |
| 8,079,181 | B2 | 12/2011 | Goerz et al. | |
| 8,142,038 | B2 * | 3/2012 | Li | F21V 33/0044 362/125 |
| 9,863,690 | B1 * | 1/2018 | Demiroez | F25D 23/02 |
| 10,281,191 | B2 * | 5/2019 | Arslankiray | F24C 15/02 |
| 2009/0045712 | A1 * | 2/2009 | Laible | A47B 96/20 312/401 |
| 2012/0038258 | A1 * | 2/2012 | Park | E05D 7/0027 312/405 |
| 2012/0104909 | A1 * | 5/2012 | Kaplan | F25D 23/02 312/204 |

FOREIGN PATENT DOCUMENTS

| | | | |
|---|---|---|---|
| CN | 104075528 | A | 10/2014 |
| DE | 102006018424 | A1 | 10/2007 |
| DE | 102012200813 | A1 | 7/2013 |
| JP | S51147362 | U | 11/1976 |
| JP | S60159983 | U | 10/1985 |
| JP | 2003247774 | A | 9/2003 |
| JP | 2016169928 | A | 9/2016 |
| KR | 20070008823 | A | 1/2007 |
| WO | 2013107605 | A2 | 7/2013 |
| WO | 2016031534 | A1 | 3/2016 |

* cited by examiner

*Primary Examiner* — Kimberley S Wright

(74) *Attorney, Agent, or Firm* — Laurence A. Greenberg; Werner H. Stemer; Ralph E. Locher

(57) ABSTRACT

For the purpose of improving flexibility, a home appliance door, for example a home chiller appliance door, is proposed: The home appliance door has at least one base body and at least one front cover element, the base body and the front cover element cooperating to form a door handle recess.

12 Claims, 3 Drawing Sheets

HOME APPLIANCE DOOR

BACKGROUND OF THE INVENTION

The invention relates to a home appliance door, for example a home chiller appliance door.

From the prior art, in particular the document DE 10 2006 018 424 A1, a home chiller appliance door comprising at least one base body and at least one front cover element is already known. However, in this case an additional door handle, which is implemented separately from the base body and the front cover element, is used for applying an opening force.

SUMMARY OF THE INVENTION

An object of the invention is to provide a home appliance door with improved characteristics regarding a flexibility. This object is achieved, according to the invention, while further implementations and further developments of the invention may be gathered from the dependent claims.

A home appliance door, for example a home chiller appliance door, is proposed, comprising: at least one base body and at least one front cover element, the base body and the front cover element cooperating to form a door handle recess.

By means of the invention a flexibility of the home appliance door can be improved. For example, a design of the home appliance door may be improved. Furthermore, an improved stability of the home appliance door may be achieved. Thus, for example a fatigue strength and/or a durability of the home appliance door may be increased. In addition, an efficiency, for example a manufacturing efficiency, an installation space efficiency, a component efficiency and/or a cost efficiency, can be improved.

By a "home appliance door" is in particular to be understood at least a part and/or a portion, e.g. a sub-assembly group, of a home appliance which is in particular configured for closing and/or sealing off at least one storage space. The home appliance is in particular provided for storing and preferably tempering victuals such as beverages, meat, fish, vegetables, fruits, milk and/or dairy products in at least one operating state, advantageously for the purpose of enhancing a manageability of the stored victuals. For this purpose, the home appliance, in particular, comprises a housing which defines the at least one storage space. For example, the home appliance is embodied as a home chiller appliance, which is in at least one operating state configured for cooling victuals. The home chiller appliance could in particular be embodied as a climate cabinet, an ice-box, a refrigerator, a freezer, a refrigerator-freezer combination and/or a wine cooler. However, the home appliance could also be embodied as a home appliance for warming up and in particular for cooking victuals, e.g. an oven, a steamer and/or a microwave. In this context, "configured" is in particular to mean specifically programmed, designed and/or equipped. By an object being configured for a certain function is in particular to be understood that the object implements and/or fulfills said certain function in at least one application state and/or operating state.

Moreover, the base body may define a main part of the home appliance door and may be configured for covering the storage space at least largely or completely. For this purpose, the base body may comprise at least one rear wall which, in particular, faces the storage space, at least one front wall which, in particular, faces away from the storage space, and/or at least one side wall which, in particular, connects the rear wall and the front wall. The rear wall and/or the front wall may define a main extension plane of the base body, which is at least substantially parallel to an, in particular horizontally oriented, base and/or ground. The side wall may be arranged at least substantially perpendicular to the main extension plane of the base body. In this context, a "main extension plane" of an object is, in particular, to be understood as a plane extending parallel to a largest side of an imaginary rectangular cuboid which only just entirely encloses the object and preferably extends through a geometric center of the object. Moreover, "at least substantially parallel" is in particular to be understood as an orientation of a direction with respect to a reference direction, in particular in a plane, wherein the direction and the reference direction include an angle of 0°, the orientation in particular having a deviation of less than 15°, advantageously of less than 10° and particularly advantageously of less than 2°. Furthermore, "at least substantially perpendicular" is in particular to mean an orientation of a direction with respect to a reference direction, in particular in a plane, wherein the direction and the reference direction include an angle of 90°, the orientation in particular having a deviation of less than 15°, advantageously of less than 10° and particularly advantageously of less than 2°. In addition, the term "at least largely" is to mean, in particular, at least 55%, advantageously at least 65%, preferably at least 75%, more preferably at least 85% and particularly advantageously at least 95%.

The front cover element may be configured for covering the front wall of the base body at least partly and/or at least largely and/or completely. The front cover element may be implemented, in an assembled state, separately from the base body and connected to the base body, for example the front wall, e.g. in a form-fit, a force-fit and/or a bonded manner. The front cover element may be dimensionally stable. In particular, the front cover element may be implemented in multiple parts and/or integrally. For example, the front cover element is implemented as a furniture door and/or as a decorative panel and/or a decorative frame. "Implemented integrally" is in particular to mean, in this context, connected at least by substance-to-substance bond, e.g. by a welding process, an adhesive bonding, an injection-molding process and/or by another process that is deemed expedient by a person having ordinary skill in the art. For example, "implemented integrally" could in particular mean made of one piece. "Made of one piece" is, in particular, to mean, in this context, manufactured from one single piece, e.g. by production from one single cast and/or by manufacturing in a one-component or multi-component injection-molding process, and advantageously from a single blank. The term "cooperating" is to be understood, in this context, in particular, as directly delimiting and/or forming. A "door handle recess" is in particular to be understood as a recess which directly forms at least a part and/or a portion of a door handle. For example, the door handle recess is configured for directly applying an opening force, in particular for opening the home appliance door. The home appliance door may in particular be free from a door handle protruding from the front wall in a direction away from the storage space.

In particular, for decreasing an opening force and/or increasing an ease of use, it is proposed that the door handle recess has a depth of at least 10 mm or at least 12.5 mm or at least 15 mm.

The door handle recess may be hidden and/or covered by the front cover element at least when viewed in a direction which is at least substantially perpendicular to a main extension plane of the base body and in particular a direction which is at least substantially perpendicular to the front wall. In this way, in particular, a manufacturing process and/or assembling process may be improved. Moreover, a design of the home appliance door may be improved.

The front cover element may be adjustable with respect to the base body and in particular movably connected to the base body, in particular for easily adjusting a position of the front cover element with respect to the base body. For this purpose, the home appliance door may comprise a, for example at least partly flexible, adjusting element which is in particular configured to adjust the front cover element with respect to the base body. A "flexible object" is in particular to mean an object which comprises at least one subpart and/or subregion which in a normal operating state is, for example elastically, changeable in its position by at least 0.25 mm or by at least 0.5 mm or by at least 1 mm or by at least 2 mm, and which may generate a counterforce acting counter to the change in position, wherein the counterforce is a function of the change and may be proportional to the change.

The base body may comprise at least one closure element, which in particular forms and/or defines the rear wall and/or the front wall of the base body, and at least one frame element which at least partly encompasses the closure element, the frame element in particular forming and/or defining the at least one side wall of the base body and/or at least a part and/or portion of the side wall of the base body. The closure element may be configured for covering the storage space at least largely or completely. Moreover, the closure element may be implemented at least partly or at least largely or completely, of a transparent material, e.g. plastic and/or glass. The frame element may be implemented separately from the closure element and may be connected to the closure element in a form-fit, a force-fit and/or a bonded manner. The frame element may be implemented integrally. The frame element may be different from a mere coating and, in particular, configured to cover, hold, fasten and/or stabilize the closure element. For this purpose, the home appliance door may further comprise a, e.g. at least partly flexible, clamping element which may be configured to secure the closure element for example together with the frame element. In this way, in particular, a heat exchange can be controlled. Moreover, a manufacturing efficiency may be improved.

The frame element may cooperate with the front cover element to form the door handle recess. In this way, in particular an installation space efficiency and/or a component efficiency may be improved advantageously.

In addition, the frame element may comprise at least one setback for defining the door handle recess. A "setback" is, in particular, to be understood as a step-like recession and/or a stepped structure, for example comprising exactly one step, in particular if viewed in a direction which is at least substantially perpendicular to the front wall and may start from the front wall, for example from a front edge connecting the front wall and the side wall. Therefore, the frame element may comprise a stepped structure extending merely in one direction, in particular, such that the stepped structure continuously widens or continuously tapers. The frame element may further comprise at least one or exactly one, rear edge protrusion delimiting the setback. The rear edge protrusion may be arranged in close vicinity of the rear wall and/or of a rear edge connecting the rear wall and the side wall. In this context, "a close vicinity" is in particular to be understood as a spatial region which is formed by points having a distance from a reference point and/or a reference component which is less than 3 cm or less than 2 cm or less than 1 cm or less than 0.5 cm. In this way, in particular, sufficient space for the door handle recess may be created easily.

The frame element may be implemented at least partly, at least largely and/or completely of plastic. The frame element may also be implemented at least partly or at least largely or completely, of metal, for example steel and/or aluminum. By using steel and/or aluminum, a fatigue strength and/or a durability of the home appliance door may be improved.

The frame element may be implemented as a hollow profile. In this case, the frame element may comprise at least one inner cavity with an at least substantially circular and/or rectangular shape and/or cross section. By an "at least substantially circular and/or rectangular object", is to be understood in particular an object which differs from a circular and/or rectangular reference object by an area portion which is less than 20%, advantageously less than 15% and in particular advantageously less than 10%. In this way, in particular, cost efficiency and/or material efficiency may be improved.

Also the frame element may be implemented as a side cover element for example for covering a side of the closure element and in particular installation parts of the base body and/or of the closure element. In this way, in particular a design of the home appliance door can be improved. Moreover, the base body can be protected from dirt and/or dust.

Furthermore, the frame element may have at least one holding section for holding at least one adjusting element, in particular the aforementioned adjusting element, which is configured to adjust a position of the front cover element with respect to the base body. The adjusting element may be in an assembled state implemented separately from the frame element and connected to the frame element, for example in a form-fit, a force-fit and/or a bonded manner. In this way, a particularly flexible home appliance door may be obtained. Moreover, an appearance of the home appliance door may be individually adapted.

Moreover, the frame element may have at least one further holding section for holding at least one clamping element, for example the aforementioned clamping element, which is configured to secure the closure element. The holding section and the further holding section may be arranged at least substantially perpendicular to each other. The clamping element may be implemented separately from the frame element and connected to the frame element in an assembled state, for example in a form-fit, a force-fit and/or a bonded manner. In this way, a particularly flexible home appliance door with an improved installation space efficiency and/or component efficiency may be obtained.

Herein the home appliance door is not to be limited to the application and implementation described above. In particular, for the purpose of fulfilling a functionality herein described, the home appliance door may comprise a number of respective elements, structural components and units that differs from the number mentioned herein. Furthermore, regarding the value ranges mentioned in this disclosure, values within the limits mentioned are to be understood to be also disclosed and to be used as applicable.

Further advantages may become apparent from the following description of the drawing. In the drawing an exemplary embodiment of the invention is shown. The drawing, the description and the claims contain a plurality of features in combination. The person having ordinary skill in the art will purposefully also consider the features separately and will find further expedient combinations.

DETAILED DESCRIPTION OF THE INVENTION

Figure 1:
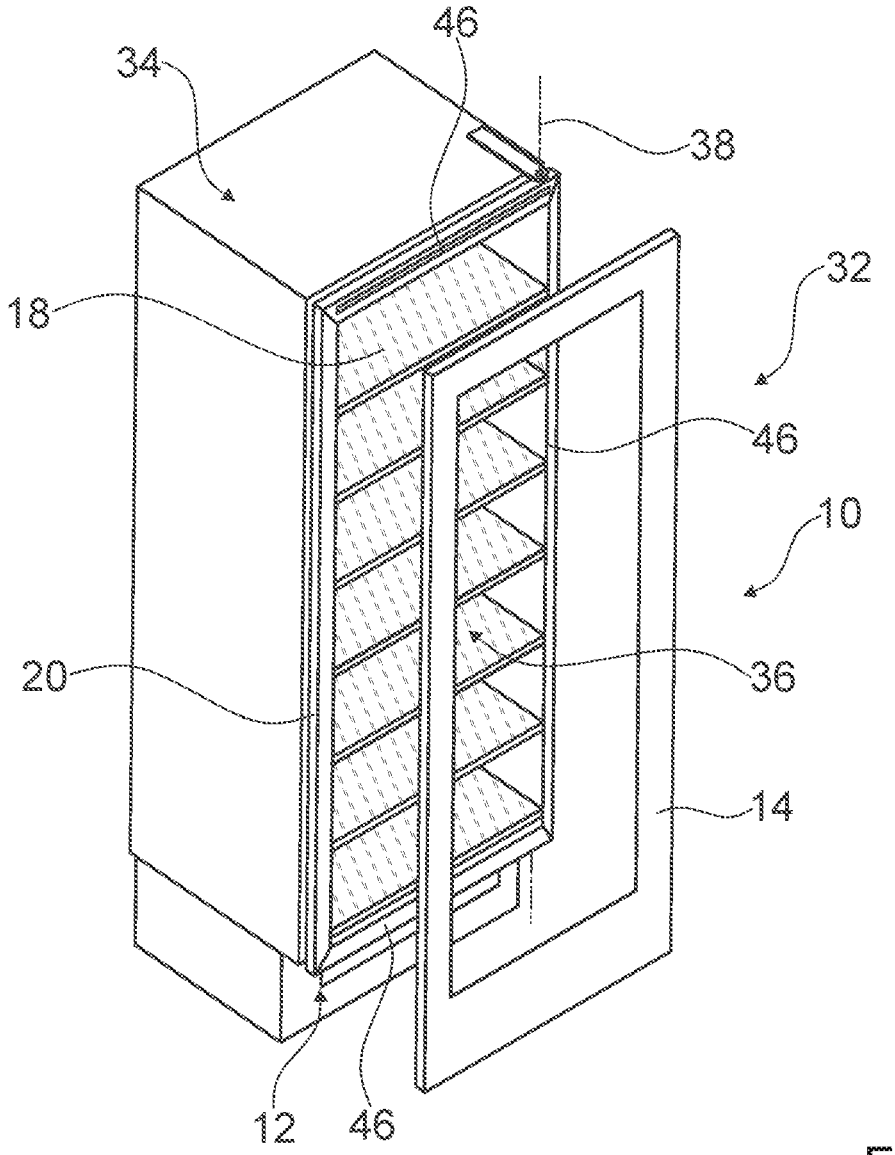
FIG. 1 a home appliance comprising a housing and a home appliance door with a base body and a front cover element in an unassembled state, in a schematic front view, FIG. 2 the home appliance door, in a perspective bottom view, FIG. 3 a portion of the home appliance door showing a side wall of the base body, in a detailed view, FIG. 4 the portion of the home appliance door showing the side wall of the base body, in a schematic view, and FIG. 5 a frame element of the base body, in a detailed view.

FIG. 1 shows a perspective view of an exemplary home appliance 32. In the present case, the home appliance 32 is implemented as a home chiller appliance, in particular as a wine cooler. Alternatively, a home appliance could be embodied as any other kind of home chiller appliance, like a refrigerator, a freezer and/or a refrigerator-freezer combination. In addition, a home appliance could also be embodied as a home appliance for warming up and in particular for cooking victuals, e.g. an oven, a steamer and/or a microwave.

The home appliance 32 is configured for cooling victuals. For this purpose, the home appliance 32 comprises a housing 34. The housing 34 defines a storage space 36, in particular for storing and tempering the victuals.

The home appliance 32 further comprises a home appliance door 10. The home appliance door 10 is movably connected to the housing 34. In the present case, the home appliance door 10 is pivotally connected to the housing 34. The home appliance door 10 is pivotable about a pivot axis 38 which is perpendicular to a base, a ground and/or a floor space of the home appliance 32. In a closed state, the home appliance door 10 closes off and seals off the housing 34 in particular the storage space 36. Alternatively, a home appliance door could be pivotable about a pivot axis which is parallel to a base, a ground and/or a floor space of a home appliance. Moreover, a home appliance door may be connected to a housing in a linearly movable manner and/or in a push-pull manner.

Figure 2:
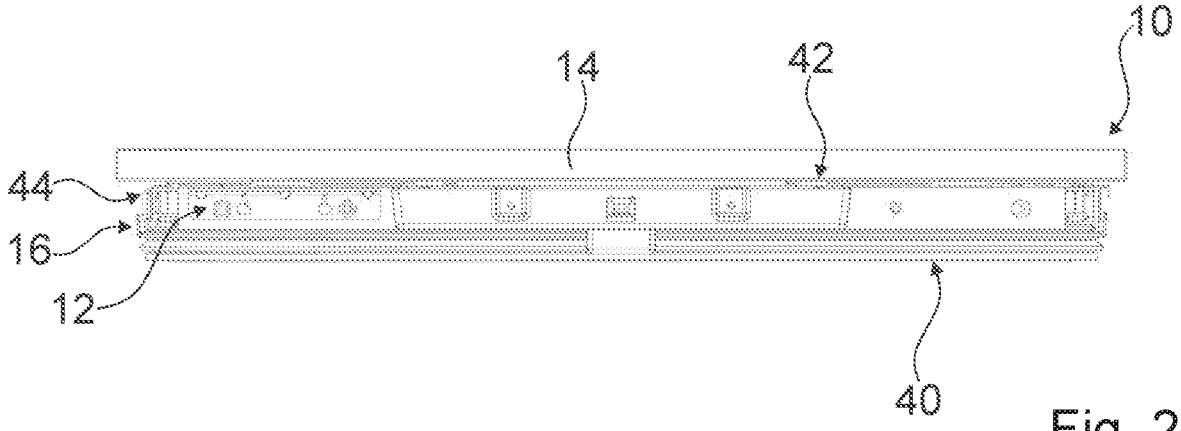
Figure 3:
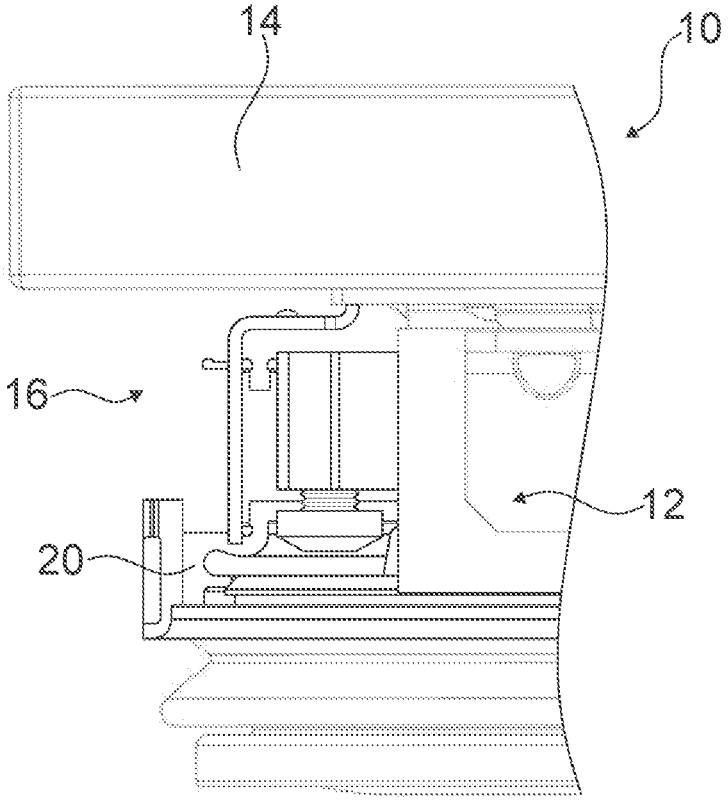
Figure 4:
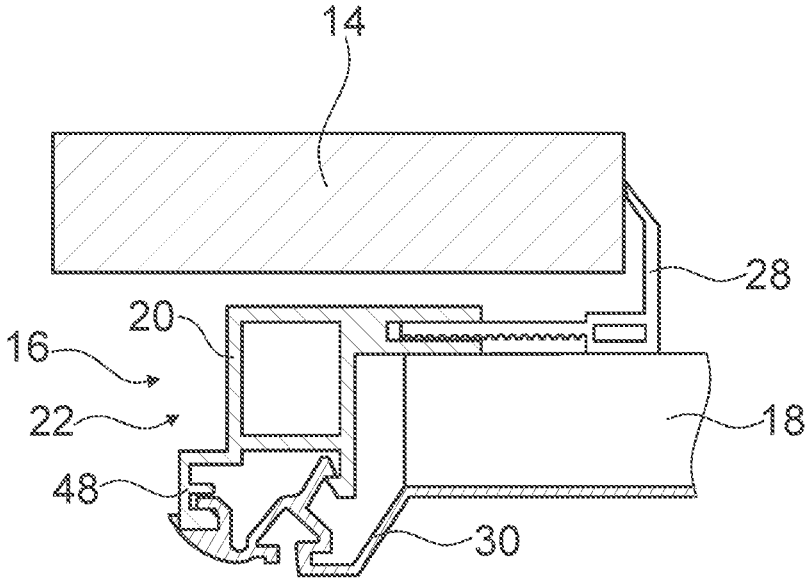

FIGS. 2 to 4 show the home appliance door 10 in different views from the bottom. The home appliance door 10 comprises a base body 12. The base body 12 defines a main part of the home appliance door 10. The base body 12 is configured for covering the storage space 36 completely.

For this purpose, the base body 12 comprises a closure element 18. The closure element 18 is plate-shaped. The closure element 18 is implemented of a transparent material, in the present case in particular glass. The closure element 18 defines and/or forms a rear wall 40 and a front wall 42 of the base body 12. The rear wall 40 faces the storage space 36. The front wall 42 faces away from the storage space 36. The front wall 42 is parallel to the rear wall 40. The rear wall 40 and the front wall 42 define a main extension plane of the base body 12. The main extension plane of the base body 12 is at least substantially parallel to the base, the ground and/or the floor space of the home appliance 32.

In addition, the base body 12 comprises at least one frame element 20. The frame element 20 is implemented separately from the closure element 18. The frame element 20 is implemented integrally. The frame element 20 is implemented as a hollow profile and comprises an inner cavity with a rectangular cross section (see FIG. 5). The frame element 20 is implemented of metal, in the present case in particular aluminum. The frame element 20 encompasses the closure element 18 at least partly. In an assembled state, the frame element 20 contacts the closure element 18. The frame element 20 defines and/or forms a side wall 44 of the base body 12, in the present case in particular a lateral side wall having a longitudinal extension which is at least substantially parallel to the pivot axis 38 and/or at least substantially perpendicular to the base, the ground and/or the floor space of the home appliance 32. The frame element 20 is arranged opposite the pivot axis 38. The frame element 20 extends over the whole longitudinal extension of the closure element 18. Moreover, the frame element 20 is implemented as a side cover element for covering a side of the closure element 18 and in particular installation parts of the base body 12. For completely encompassing the closure element 18, the base body 12 comprises three further frame elements 46, which are arranged on different sides of the closure element 18 with respect to the frame element 20. Alternatively, a frame element and further frame elements may be implemented integrally.

In addition, the home appliance door 10 comprises at least one front cover element 14. In the present case, the home appliance door 10 comprises exactly one front cover element 14. The front cover element 14 is implemented separately from the base body 12. The front cover element 14 is connected to the base body 12 in an assembled state. In the present case, the front cover element 14 is connected to the base body 12 in a form-fit and/or force-fit manner. The front cover element 14 is connected to the base body 12 in such a manner that the front cover element 14 is adjustable and/or movable with respect to the base body 12. Moreover, the front cover element 14 is arranged above the front wall 42 in particular in such a manner that the front wall 42 is partly covered by the front cover element 14. In the present case, the front cover element 14 covers at least the frame element 20 and in particular the further frame elements 46 at least when viewed in a direction which is at least substantially perpendicular to the front wall 42. In the present case, the front cover element 14 is implemented as a frame, in particular a decorative frame. Alternatively, a front cover element may be connected to a base body in a bonded manner. Moreover, a front cover element may be implemented as a decorative panel and/or a furniture door. In addition, a front cover element could cover a front wall completely.

The base body 12 and the front cover element 14 cooperate to form a door handle recess 16. In the present case, the frame element 20 cooperates with the front cover element 14 to form the door handle recess 16. Thus the frame element 20 and the front cover element 14 delimit the door handle recess 16. The door handle recess 16 has a depth of at least 15 mm. The door handle recess 16 is covered by and/or hidden by the front cover element 14 at least when viewed in a direction which is at least substantially perpendicular to the main extension plane of the base body 12 and/or to the front wall 42. The door handle recess 16 directly forms a door handle. The door handle recess 16 is configured for applying an opening force, in particular for uncovering the storage space 36.

Figure 5:
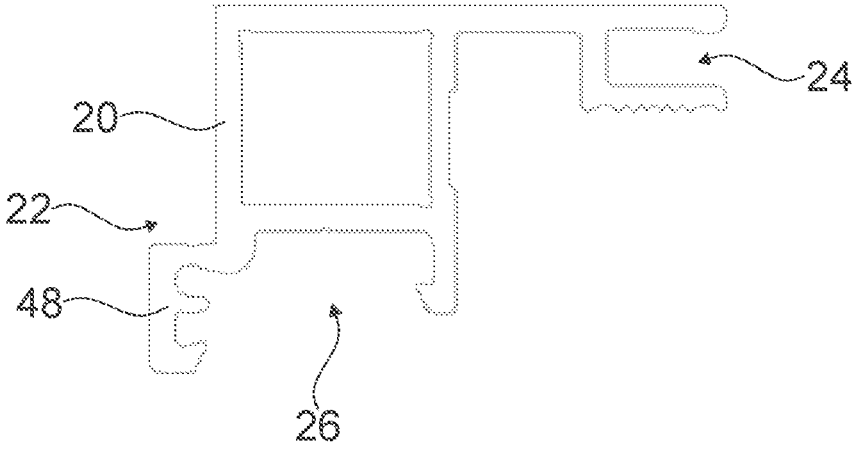

For this purpose, the frame element 20 comprises at least one setback 22 (see FIGS. 4 and 5). In the present case, the frame element 20 comprises exactly one setback 22. The setback 22 corresponds to a step-like recession. The setback 22 starts from the front wall 42 and extends towards the rear wall 40. The setback 22 extends over at least 55%, preferably at least 65%, more preferably at least 75% and most preferably at least 85% of the frame element 20 in a direction from the front wall 42 to the rear wall 40. The setback 22 delimits and in the present case in particular creates space for the door handle recess 16.

Moreover, the frame element 20 comprises at least one rear edge protrusion 48. In the present case, the frame element 20 comprises exactly one rear edge protrusion 48. The rear edge protrusion 48 is arranged in close vicinity of a rear edge connecting the rear wall 40 and the side wall 44. The rear edge protrusion 48 protrudes in a direction which is parallel to the main extension plane of the base body 12. In the present case, the rear edge protrusion 48 protrudes in a direction which is perpendicular to the pivot axis 38. The rear edge protrusion 48 delimits the setback 22. Moreover, the rear edge protrusion 48 delimits the door handle recess 16. Alternatively, a frame element may comprise at least two, at least three and/or at least four setbacks, and/or at least two, at least three and/or at least four protrusions. Moreover, it is conceivable to apply an additional coating to a door handle recess in particular to improve a durability and/or haptic features of the door handle recess.

In addition, the frame element 20 comprises at least one holding section 24, 26 (see FIGS. 4 and 5). In the present case, the frame element 20 comprises two holding sections 24, 26. The holding sections 24, 26 are arranged at least substantially perpendicularly to each other.

A first holding section 24 of the holding sections 24, 26 is arranged in close vicinity of the front cover element 14. The first holding section 24 is arranged at least largely between the front cover element 14 and the closure element 18. The first holding section 24 is configured for holding an adjusting element 28 of the home appliance door 10. The adjusting element 28 is at least partly flexible. The adjusting element 28 contacts an inner wall of the front cover element 14 which is at least substantially perpendicular to the main extension plane of the base body 12. The adjusting element 28 is configured to adjust the front cover element 14 with respect to the base body 12. A functional principle of the adjusting element 28 is explicitly disclosed in the document DE 10 2006 018 424 A1 the disclosure of which is herein incorporated by reference.

A second holding section 26 of the holding sections 24, 26 is arranged in close vicinity of the rear wall 40. The second holding section 26 is configured for holding a clamping element 30 of the home appliance door 10. The clamping element 30 is at least partly flexible. The clamping element 30 contacts an inner wall of the closure element 18 and/or the rear wall 40. The clamping element 30 is configured to secure the closure element 18. In the present case, the clamping element 30 and the frame element 20 are configured to clamp the closure element 18. A functional principle of the clamping element is explicitly disclosed in the document DE 10 2006 018 424 A1, the disclosure of which is herein incorporated by reference.

The following is a summary list of reference numerals and the corresponding structure used in the above description of the invention:

10 home appliance door
12 base body
14 front cover element
16 door handle recess
18 closure element
20 frame element
22 setback
24 holding section
26 holding section
28 adjusting element
30 clamping element
32 home appliance
34 housing
36 storage space
38 pivot axis
40 rear wall
42 front wall
44 side wall
46 frame element
48 rear edge protrusion

The invention claimed is:

1. A home appliance door, comprising: a base body and a front cover element, the base body and the front cover element cooperating to form a door handle recess, the door handle recess being delimited by the base body and the cover element, the base body including a closure element and a frame element, the frame element at least partly encompassing the closure element and extending over an entire length of said door handle recess and the frame element having a rear edge protrusion protruding away from the closure element, the rear edge protrusion defining a setback, said setback defining a depth of the door handle recess, a clamping element clamping the closure element to the frame element, the rear edge protrusion defining a holding section for holding the clamping element in position for clamping the closure to the frame element.

2. The home appliance door according to claim 1, wherein the depth of the door handle recess is at least 10 mm.

3. The home appliance door according to claim 1, wherein the door handle recess is hidden by the front cover element at least when viewed in a direction which is at least substantially perpendicular to a main extension plane of the base body.

4. The home appliance door according to claim 1, wherein the front cover element is adjustable with respect to the base body.

5. The home appliance door according to claim 1, wherein the frame element cooperates with the front cover element to form the door handle recess.

6. The home appliance door according to claim 1, wherein the frame element is implemented at least partly of metal.

7. A home appliance door, comprising: a base body and a front cover element, the base body and the front cover element cooperating to form a door handle recess, the door handle recess being delimited by the base body and the cover element, the base body including a closure element and a frame element, the frame element being implemented as a hollow profile, the frame element at least partly encompassing the closure element and extending over an entire length of said door handle recess and the frame element having a protruding edge defining a setback, said setback defining a depth of the door handle recess.

8. The home appliance door according to claim 1, wherein the frame element is implemented as a side cover element.

9. The home appliance door according to claim 7, further comprising the frame element having at least one holding section for holding at least one adjusting element which is configured to adjust a position of the front cover element with respect to the base body.

10. A home appliance, comprising a housing which defines at least one storage space, and at least one home appliance door according to claim 1, configured for closing the at least one storage space.

11. The home appliance door according to claim 1, wherein the frame element having a further holding section for holding at least one adjusting element which is configured to adjust a position of the front cover element with respect to the base body, the further holding section is disposed on an opposite side of the frame element in a thickness direction of the appliance door.

12. The home appliance door according to claim 1, wherein the cover element and the closure element defines opposite outer faces of the appliance door.

* * * * *